US009736890B2

(12) United States Patent
Chaffey et al.

(10) Patent No.: US 9,736,890 B2
(45) Date of Patent: Aug. 15, 2017

(54) TEMPERATURE SENSING AND HEATING DEVICE

(75) Inventors: Jason Phillip Chaffey, Victoria (AU); Miroslav Miljanic, Victoria (AU)

(73) Assignee: BLUECHIIP LIMITED, Victoria (AU)

( * ) Notice: Subject to any disclaimer, the term of this patent is extended or adjusted under 35 U.S.C. 154(b) by 858 days.

(21) Appl. No.: 13/982,346

(22) PCT Filed: Dec. 22, 2011

(86) PCT No.: PCT/AU2011/001661
§ 371 (c)(1),
(2), (4) Date: Sep. 25, 2013

(87) PCT Pub. No.: WO2012/100281
PCT Pub. Date: Aug. 2, 2012

(65) Prior Publication Data

US 2014/0008355 A1 Jan. 9, 2014

(30) Foreign Application Priority Data

Jan. 28, 2011 (AU) ..... 2011900278

(51) Int. Cl.
*H05B 6/06* (2006.01)
*H05B 6/12* (2006.01)
*A23C 9/12* (2006.01)

(52) U.S. Cl.
CPC ..... *H05B 6/06* (2013.01); *H05B 2213/07* (2013.01)

(58) Field of Classification Search
CPC ..... H05B 6/06; H05B 2213/07; H05B 6/12; H05B 6/062; A47J 36/02; A47J 27/002
USPC ..... 219/620, 621, 622, 624, 626, 627, 665, 219/663; 99/624, 627; 426/35, 392, 235, 426/231, 518
See application file for complete search history.

(56) References Cited

U.S. PATENT DOCUMENTS 6,232,585 B1 5/2001 Clothier et al.
6,255,635 B1 7/2001 Thompson et al.
6,271,508 B1 8/2001 Thompson et al.
6,274,856 B1 8/2001 Clothier et al.
6,316,753 B2 11/2001 Clothier et al.
(Continued)

FOREIGN PATENT DOCUMENTS

JP 2004 144683 5/2004

OTHER PUBLICATIONS

International Search Report Issued Feb. 22, 2012 in PCT/AU11/001661 Filed Dec. 22, 2011.

*Primary Examiner* — Quang Van
(74) *Attorney, Agent, or Firm* — Oblon, McClelland, Maier & Neustadt, L.L.P.

(57) ABSTRACT

An induction heating system including a container for storing a substance; a heating element in thermal contact with the substance; a machine readable tag in thermal contact with the substance, the tag having a machine readable temperature-dependant characteristic; an interrogator for reading the temperature-dependant characteristic of the tag and for determining the current temperature of the substance; an induction heater for generating an AC magnetic field to heat the heating element; and a heater controller for controlling operation of the induction heater, in response to the substance temperature determined by the interrogator, to heat the substance.

16 Claims, 8 Drawing Sheets

(56) References Cited

U.S. PATENT DOCUMENTS

| | | | | |
|---|---|---|---|---|
| 6,316,756 | B1 | 11/2001 | Thompson et al. | |
| 6,444,961 | B2 | 9/2002 | Clothier et al. | |
| 6,504,135 | B2 | 1/2003 | Clothier et al. | |
| 6,521,874 | B2 | 2/2003 | Thompson et al. | |
| 6,730,894 | B2 | 5/2004 | Thompson et al. | |
| 2001/0007323 | A1 | 7/2001 | Clothier et al. | |
| 2001/0019051 | A1 | 9/2001 | Clothier et al. | |
| 2001/0042747 | A1 | 11/2001 | Clothier et al. | |
| 2001/0045427 | A1 | 11/2001 | Thompson et al. | |
| 2002/0063124 | A1 | 5/2002 | Clothier et al. | |
| 2002/0108948 | A1 | 8/2002 | Clothier et al. | |
| 2003/0071034 | A1 | 4/2003 | Thompson et al. | |
| 2003/0094450 | A1 | 5/2003 | Clothier et al. | |
| 2003/0102303 | A1 | 6/2003 | Clothier et al. | |
| 2003/0185937 | A1* | 10/2003 | Garwood ..... | A22B 5/0029 426/35 |

* cited by examiner

TEMPERATURE SENSING AND HEATING DEVICE

FIELD OF THE INVENTION

The present invention relates to the heating of substances stored in containers. The Invention is suitable for use in heating chemical assay samples, stem cell samples and other biological samples in vials or test tubes, and it will be convenient to describe the invention in relation to that exemplary application. It is to be appreciated however, that the invention may be, used in a wide variety of applications in which substances stored in containers are required to be heated.

BACKGROUND OF THE INVENTION

Biological samples are collected and stored in many different types of facilities for a great variety of applications. Such applications include the storage of samples collected during clinical trials in pharmaceutical companies, research samples used in university laboratories, samples archived in hospitals, samples used in the discovery of biological marks for diagnostic testing, forensic samples from crime or disaster scenes and so on.

Vials and other containers used to store such samples are frequently required to be heated and stored at temperatures higher than room temperature. Typically, heat is applied by placing the vials in a water bath where the water is maintained at a constant temperature. Alternatively, resistive elements are formed in the base of some vials, and electrical connections are provided on the vial so that the resistive element can be connected to a heating circuit. The heating circuit supplies current through the resistive element in order to heat the vial. These systems are limited to the maximum temperature of the sample that can be achieved.

Existing methods of heating samples can be slow (time to heat sample) and uncontrollable. In addition, water baths pose a risk of contamination to samples being heated and between samples, and while the bath temperature can be monitored, individual vial or tuba sample temperature cannot be monitored. Such vial heating systems provide inaccurate heating of substances stored in the vial.

It would be desirable to provide a system for heating substances stored in containers which ameliorates or overcomes one or more disadvantages of known heating systems, or at least provides an alternative to known induction heating systems.

The above discussion of background art is included to explain the context of the present invention. It is not to be taken as an admission that any part of the prior art referred to was published, known or part of the common general knowledge at the priority date of any one of the claims of this specification.

SUMMARY OF THE INVENTION

One aspect of the invention provides an induction heating system including:

- a container for storing a substance;
- a heating element in thermal contact with the substance;
- a machine readable tag in thermal contact with the substance, the tag having a machine readable temperature-dependant characteristic;
- an interrogator for reading the temperature-dependant characteristic of the tag and for determining the current temperature of the substance;

- an induction heater for generating an AC magnetic field to heat the heating element; and
- a heater controller for controlling operation of the induction heater, in response to the substance temperature determined by the interrogator, to heat the substance.

In one or more embodiments, the tag includes at least one resonant member having the temperature-dependant characteristic. For example, the temperature-dependant characteristic is a shift in resonant frequency of the resonant member as a function of temperature.

In one or more embodiments, the tag stores a tag identifier, and wherein the interrogator acts to read the tag identifier. In this case, the tag may include a plurality of resonant members encoding the tag identifier.

The various resonant members may have different resonant frequencies from each other.

The resonant members may be vibrated by a Lorentz-type force on application of an excitation signal to the tag.

In one or more embodiments, the tag is affixed to the container. As an example, the tag may formed in a wall of the container.

In one or more embodiments, the heating element may be affixed to the container, for example, by being formed in a wall of the container.

In one or more embodiments, the heating element is mounted on the tag.

In one or more embodiments, the induction heating system includes:

- an induction coil forming part of a tank circuit;
- a control circuit for supplying AC current to the tank circuit; and
- tuning circuitry to match the frequency of AC current to the resonant frequency of the tank circuit.

In one or more embodiments, the tuning circuitry includes frequency determining circuitry to determine the resonant frequency of the tank circuit and frequency modulation circuitry to adjust the frequency of the AC current to the resonant frequency of the tank circuit.

In one or more embodiments, the heater controller further acts to control operation of the induction heater to heat the substance, in response to an input substance temperature set-point.

In one or more embodiments, the heater controller further acts to control operation of the induction heater to heat the substance, in response to an input substance temperature heating rate.

Another aspect of the invention includes a method of heating a substance stored in a container, wherein a heating element and a machine readable tag are in thermal contact with the substance, the tag having a machine readable temperature-dependant characteristic, the method including the steps of:

- reading the temperature-dependant characteristic of the tag and determining the current temperature of the substance;
- inducing an AC magnetic field in an interrogation coil to thereby heat the heating element; and
- controlling the AC magnetic field, in response to the determined substance temperature, to heat the substance.

In one or more embodiments, the tag includes at least one resonant member having the temperature-dependant characteristic of a shift in resonant frequency of the resonant member as a function of temperature, and the reading step includes reading the resonant frequency of the resonant member.

Preferably, the tag stores a tag identifier, and wherein the method further includes the step of the interrogator acting to read the tag identifier. In this case, the tag may include a plurality of resonant members encoding the tag identifier, the resonant members have different resonant frequencies from each other, and wherein the method further includes the step of reading the resonant frequencies of the tag to determine the tag identifier.

In one or more embodiments, the method further includes the step of applying an excitation signal to the tag to cause vibration of the resonant members by a Lorentz-type force.

In one or more embodiments, an induction heater heats the substance, the induction heater including an induction coil forming part of a tank circuit; a control circuit for supplying AC current to the tank circuit; and tuning circuitry, including frequency determining circuitry, to match the frequency of AC current to the resonant frequency of the tank circuit. In this case, the method may further include the step of the frequency determining circuitry determining the resonant frequency of the tank circuit and frequency modulation circuitry to adjust the frequency of the AC current to the resonant frequency of the tank circuit.

In one or more embodiments, the method may further include the step of the heater controller controlling operation of the induction heater to heat the substance, in response to an input substance temperature set-point.

In one or more embodiments, the method may further include the step of the heater controller controlling operation of the induction heater to heat the substance, in response to an input substance temperature heating rate.

Embodiments of the invention will now be described by way of example only, with reference to the accompanying drawings. It is to be understood that the particularity of the drawings and embodiments does not supersede the generality of the preceding description of the invention.

DETAILED DESCRIPTION OF EMBODIMENTS OF THE INVENTION

Figure 1:
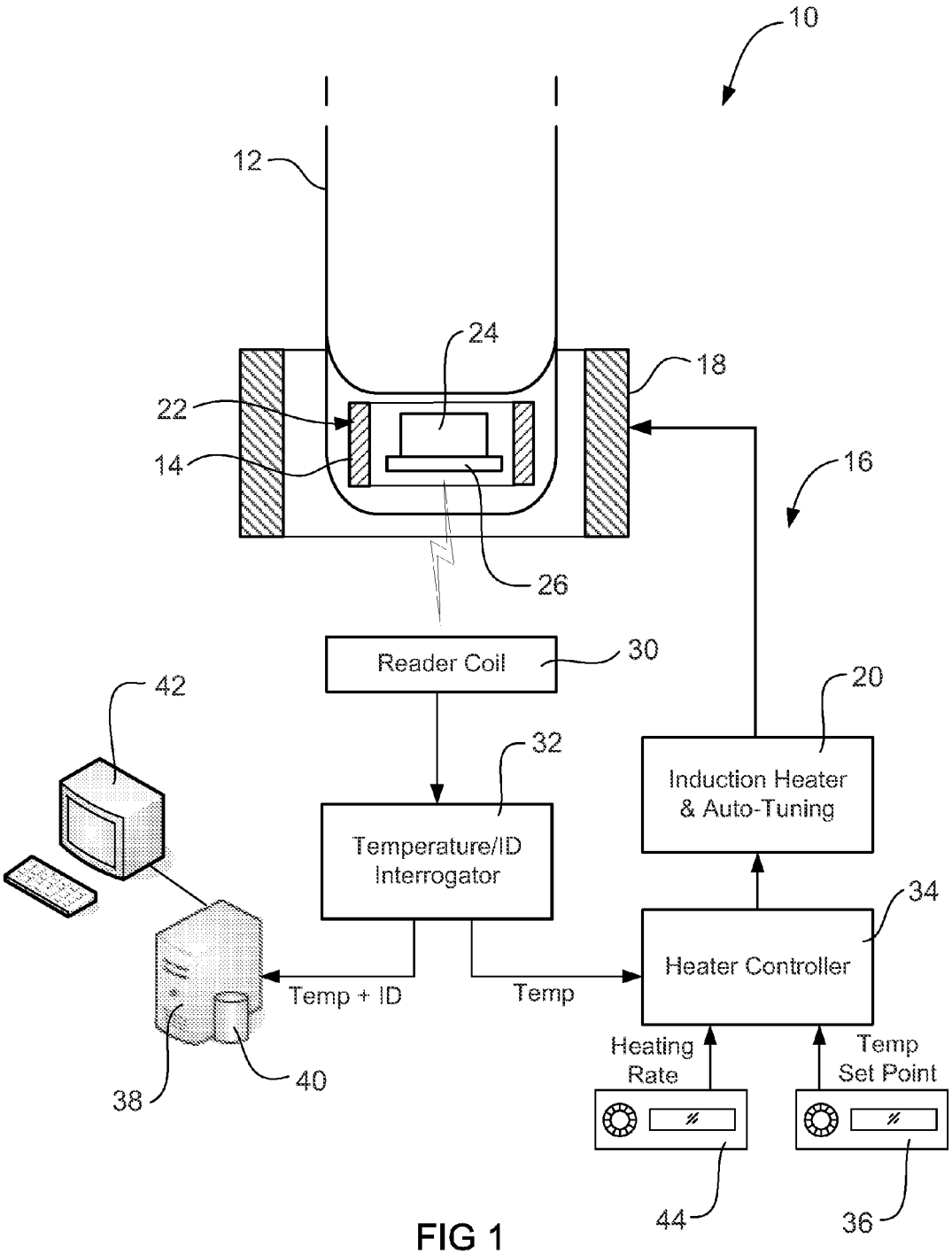
FIG. 1 is a schematic diagram of an induction heating system in accordance with one embodiment of the present invention.

FIG. 1 depicts a system 10 for heating a substance stored in a container 12, in this case, a vial. The induction heating system 10 includes a conductive ring or like heating element 14. The heating element 14 is preferably formed from an electrically conductive and/or ferromagnetic material and may conveniently be formed from a metal or a metal alloy with a high magnetic permeability, such as steel, nickel or other ferromagnetic material. The heating element 14 is affixed to the vial 12 so as to be in thermal contact with substances stored within the vial. In the embodiment depicted in FIG. 1, the heating element 14 is formed in a wall of the vial 12.

The heating element 14 is used by the induction heating system 10 to generate heat locally via an induction heating process. In that regard, the induction heating system 10 further includes an induction heater 16 including notably an induction coil 18 and induction heater control unit 20 for supplying AC current to thereby generate an AC magnetic field which acts to heat the heating element 14.

In embodiments in which the heating element 14 is electrically conductive, the AC magnetic field thus generated produces eddy currents near the surface of the heating element 14. The eddy currents results in a "skin effect", that is, the tendency of an AC current to distribute itself within a conductor so that the current density near the surface of the conductor is greater than that at its core. The skin effect causes the effective resistance of the conductor to increase with the frequency of the current because much of the conductor carries little current. The magnitude of the eddy currents and the time during which the eddy currents are generated determine the temperature of the heating element 14 and thus the temperature of the substance stored in the vial 12. As different sized vials or other containers could be used, and each heating element used could have different amounts of such a conductor, the optimal frequency can change from container to container.

In embodiment in which the heating element is additionally or alternatively formed from a ferromagnetic material, application of the external AC magnetic field will cause magnetisation of the heating element. Heat will be generated by the magnetic hysteresis losses in the ferromagnetic material.

The induction coil 18 is of a sufficiently large diameter to enable insertion of the vial 12 and location of the heating element 14 sufficiently proximate the induction coil 18 for eddy currents to be induced by the AC magnetic field generated by the induction coil 18. In one practical embodiment of the invention, the induction coil may be located around an aperture formed in a vial heating unit (not shown).

The system 10 may further include a machine readable tag, such as an RFID tag 22, in thermal contact with the substance stored in the vial 12. The RFID tag 22 has a machine readable temperature-dependent characteristic to enable the temperature of the substance to be determined. The RFID tag includes an RFID chip 24 bearing temperature related data as well as a tag identifier, and antenna coil 26. In other embodiments, the tag identifier may be omitted from the tag. Conveniently, the antenna coil 26 can be integrally formed with the RFID chip 24, and packaged as a single element.

The system 10 includes an interrogator 28 for reading the data borne by the RFID chip 24 via the antenna coil 26. The interrogator 28 notably includes an interrogation coil 30 and associated interrogation circuitry 32. The interrogator circuitry 32 is adapted to generate an excitation signal in the interrogation coil 30. The excitation signal is transferred by induction to the antenna coil 26 forming part of the RFID tag 22. The RFID tag 22 draws power from the excitation signal induced in the antenna coil 26, energizing the circuits or structures in the RFID chip 24. The RFID tag 22 then transmits the data encoded in the RFID chip via the antenna coil 26.

This data is then captured by the interrogation coil 30 and read by the interrogation circuitry. The temperature dependent characteristic of the RFID tag 22 is received by the interrogation circuitry 32 which then determines the current temperature being sensed by the RFID tag 22. This temperature is provided as an input to a heater controller 34.

In this embodiment, heating and reading operations are not performed simultaneously, as the static magnetic field which is generated saturates the material from which the tag is formed and reduces the effective permeability of the material.

In one or more embodiments, the antenna coil 26 could be made from same material that is used to form the heating element 14, hence not requiring the presence of am additional metallic film.

In other embodiments, the antenna coil 26 could form the heating element 14 itself, so that during a heating period the application of an AC magnetic field would cause the antenna coil 26 to act as the heating element 14 to heating the substance stored in the vial 12. In a different reading period, in which current is not supplied to the induction coil 18, the antenna coil 26 acts enables interrogation of the date borne by the RFID tag 22.

The heater controller 34 compares the temperature information provided from the interrogator circuitry 32 to a temperature set point provided as another input from a first user selectable input device 36. Another user selectable input device 44 enables a desired temperature heating rate to be input to the heater controller 34. When the temperature read by the interrogator circuitry 32 is lower than the selected temperature set point, the heater controller 34 causes operation of the induction heater 20 so as to heat the heating element 14 at the desired input heating rate. The control can be continuous, pulse width modulated, bang-bang or other use other similar techniques. In one or more embodiments, the user selectable input devices 36 and 44 can be constituted by a suitable programmed personal computer or other computing device.

In order to provide a thermal history of the substance stored in the vial 12, the temperature read by the interrogator control unit 32 together with the tag identifier read by the interrogator circuitry 32 is continuously provided to a server 38 for storage in a database 40. The temperature profile stored in the database 40 may be accessed by user from a client terminal 42 in communication with the server 38. In will be appreciated that in other embodiments, the temperature profile may be stored locally, rather than at a remote network location as shown in FIG. 1.

Although the temperature dependent characteristic of the RFID tag 22 and the tag identifier may be provided in a number of ways, in a preferred embodiment of the invention the RFID tag 22 includes a plurality of micro-mechanical vibratable or resonant members 44 each having a particular resonant frequency. A common electrical conductor 46 runs along or through the vibratable members and extends beyond the vibratable members to electrical terminals 48 and 40. The coil antenna 26 interconnects the terminals 48 and 50. The vibratable members 44, the electrical conductor 46, the electrical terminals 48 and 50 and the coil antenna 26 may be formed on a dielectrical semiconductor substrate. An LED 52 or other light emitter may be connected across the coil antenna 26 or a separately integrated coil antenna to provide a visual indication that an excitation signal is being applied to the coil antenna.

The vibratable members 44 are caused to vibrate by an applied excitation or interrogation signal generated by the interrogator 28 that induces an alternating currently in the electrical conductor 46 by means of Faraday induction via the coil antenna 26. The exemplary vibratable members 44 are described in more detail in International Patent Application No WO 2004/084131, to the present Applicant, the entire contents of which are incorporated herein by reference.

Figure 2:
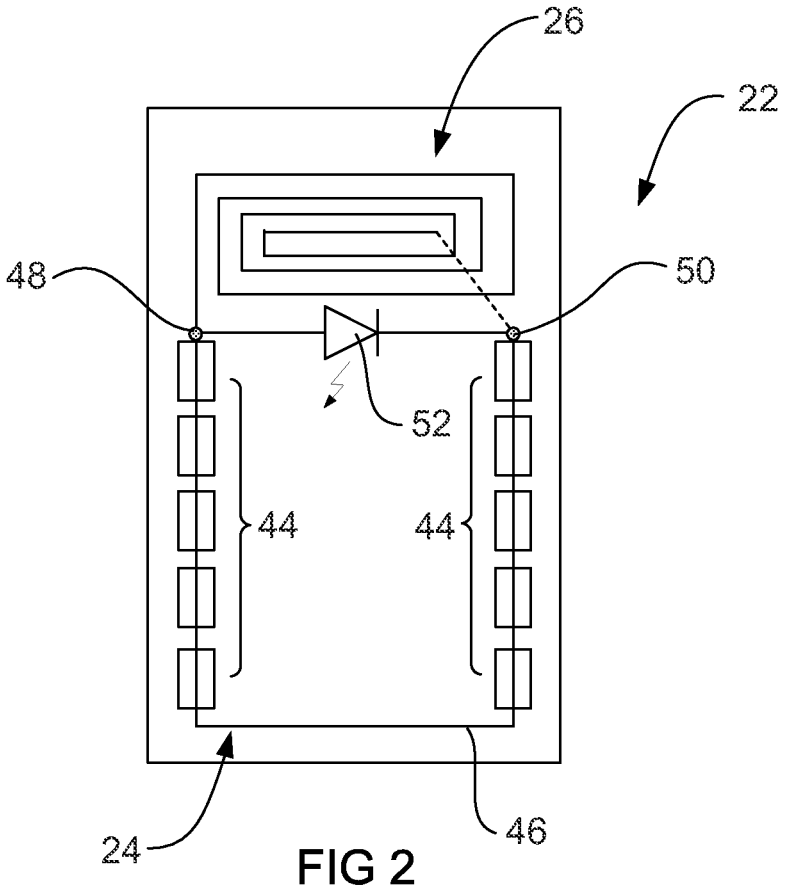
FIG. 2 is a schematic diagram of an RFID tag forming part of the system depicted in FIG. 1.
Figure 3:
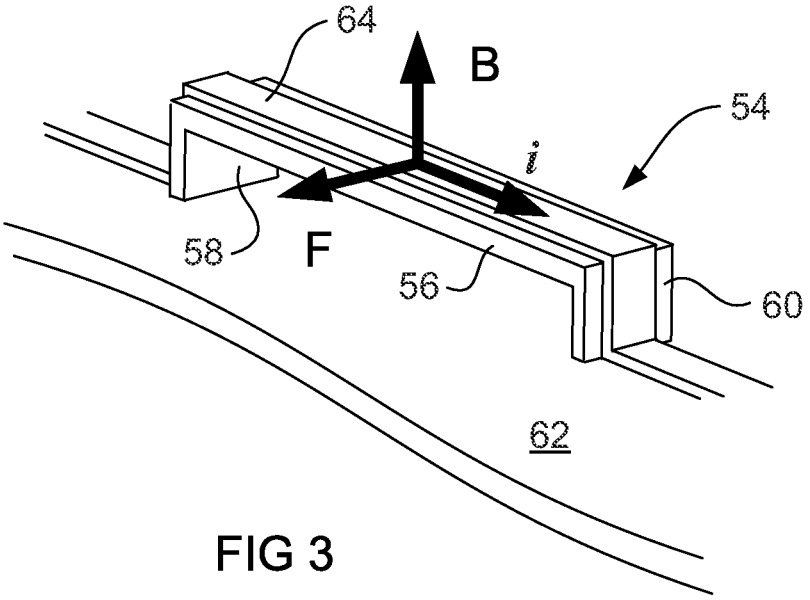
FIGS. 3 and 4 are isometric views of two different embodiments of a resonant member forming part of the tag depicted in FIG. 2.

In one embodiment, the vibratable members 44 are vibratable by a Lorenz force. The Lorentz force is the force that acts on a charged particle travelling through an orthogonal magnetic field. In this instance, a magnetic field is applied to the vibratable members 44 in a direction perpendicular to the current flow through the electrical conductor 46. FIG. 3 depicts an exemplary vibratable member in the form of a bridge structure 54 including a beam 56 supported by two columns 58 and 60 projecting from a substrate 62. The structure shown in FIG. 3 may be formed by conventional semiconductor fabrication techniques involving the use of known etching and deposition processes. Once the bridge structure 54 has been formed on the substrate 62, an electrically conductive path 64 is then deposited along the length of the structure 54. The electrically conductive path 64 forms part of the conductor 46 shown in FIG. 2.

When an interrogation signal is applied to the tag 22, alternating electrical current is induced in the antenna coil 26 which thus causes the flow of electrical current through the conductive path 64. In the presence of an orthogonal magnetic field, a force is then applied to the beam 56 in a direction that is orthogonal to both the direction of the current flow and the magnetic field direction. Since the current in the conductor 64 is an alternating current, the orthogonal force generated is also an alternating force, resulting in the vibration of the beam 56. If the frequency of the alternating current in the conductor 64 is at or new the resonant frequency of the beam 56, the beam 56 will vibrate.

Figure 4:
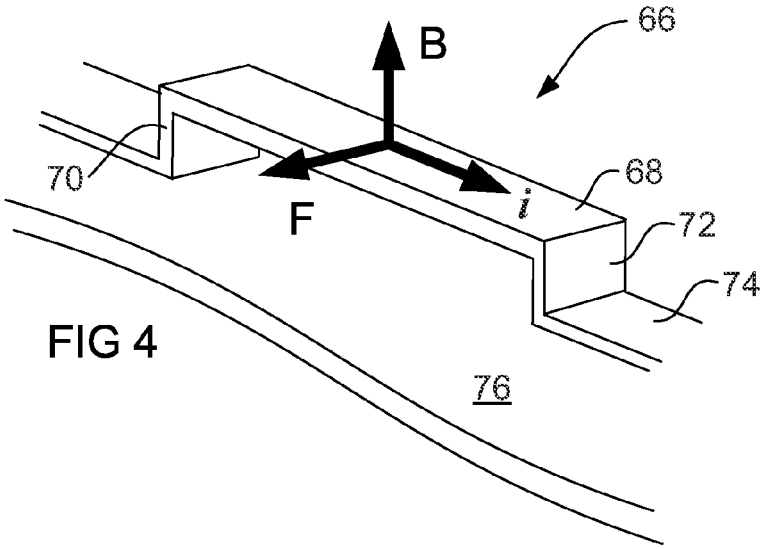

Another exemplary vibratable beam is shown in FIG. 4. In this case, the vibratable member is in the form of a bridge structure 66 including a beam 68 boarded by two columns 70 and 72. Unlike the embodiment depicted in FIG. 3 though, the beam 68 is formed from the same material as the electrically conductive path 74 supporting the two columns 70 and 72. The structure shown in FIG. 4 may be formed by conventional semiconductor fabrication techniques involving the use of known etching and deposition processes. Typically, the electrically path 74, columns 70 and 72 and beam 68 are deposited on the substrate 76 in the same deposition step(s).

Figure 5:
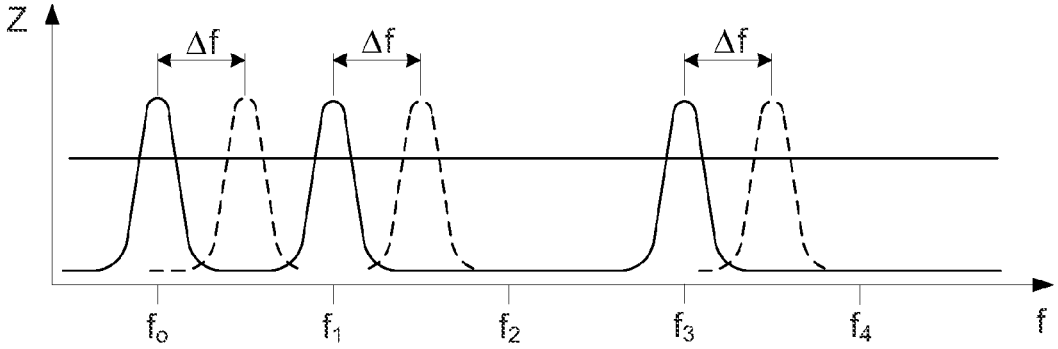
FIGS. 5 and 6 a graphical representations of the frequency response of the tag shown in FIG. 2 and depict notably a shift in the resonant frequency of the resonant member of the tag as a function of temperature.

Referring now to FIG. 5, each of the resonant members forming part of the exemplary RFID tag 22 have a notional resonant frequency corresponding to one of a predetermined number of resonant frequencies $f_1$, $f_2$, $f_3$, etc. Preferably, the resonant frequencies $f_1$, $f_2$, $f_3$, etc. are in a different frequency range—in this embodiment, a much lower range—to the frequency of the AC magnetic field generated during heating.

If the interrogator detects a resonant frequency at any of the frequency positions $f_1$ onwards, the interrogator unit 32 interprets that resonant frequency as a binary "1". By contrast, the absence of a resonant frequency at any of those predetermined frequency positions is interpreted as a binary "0". The sequence of binary 1's and 0's detected by the interrogation unit 32 corresponds to a tag identifier.

Use of tags including a plurality of micro-mechanical vibratable members of this type are ideally suited to use in temperature controlled environments for storing biological samples and in particular those environments in which extreme temperature conditions are experienced, such as those associated with liquid nitrogen. Unlike semiconductor electronics, such micro-mechanical resonant members continue to resonate and the associated tag continues to function even at such extreme temperatures. Moreover, the tag continues to function when the vial or other container to which they are affixed are heated to room temperature and beyond.

Figure 6:
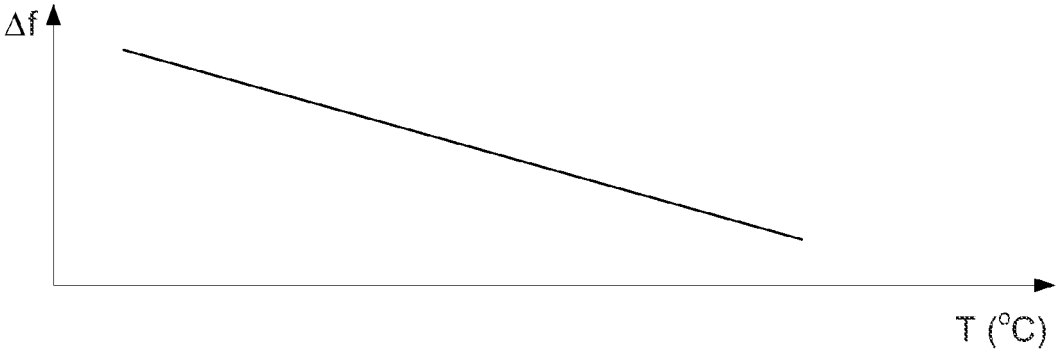

Although each of the resonant members are assigned a notional resonance frequency at one of the predetermined frequency positions $f_1$ onwards, the exact resonant frequency of each vibratable member will vary as a function of the temperature to which the vibratable members is exposed. In the example shown in FIG. 6, the shift Δf in resonant frequency of the vibratable members varies linearly as a function of temperature. It will be appreciated of course that in other embodiments of the invention vibratable members having other reproducible and reliable and temperature profiles may be used.

This correspondence between shift in resonant frequency and temperature is used by the system 10 depicted in FIG. 1 to determine the current temperature sensed by the RFID tag 22 and accordingly the temperature experienced by the substance stored in the vial 12.

Advantageously, taking advantage of this temperature dependent characteristic of the resonant members forming part of each tag enables the tag identifier encoded in each tag, as well as the temperature experienced by each tag to be read by the interrogator 28 and used by the induction heating system 10 without requiring any additional components or elements, since the shift in resonant frequency is an inherent property of the vibratable members of the tag.

The interrogator 28 and RFID tag 22 are described in greater detail in International Patent Application No. WO 2010/037166, to the present applicant, the entire contents of which are incorporated herein by reference.

Figure 7:
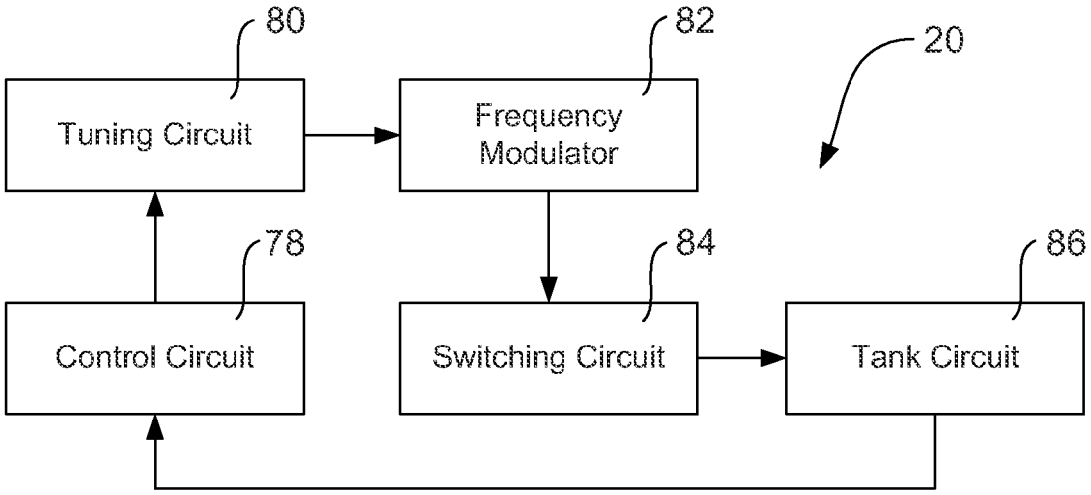
FIG. 7 is a schematic diagram depicting a number of circuit elements forming part of the induction heating system shown in FIG. 1.

FIG. 7 depicts various elements of the induction heater control unit 20 shown in FIG. 1. These elements are control circuitry 78, tuning circuitry 80, frequency modulator circuitry 82, switching circuitry 84 and a tank circuit 86 (otherwise known as an inductor resonant circuit). These various elements act to control the output frequency of the control circuitry 78 to properly match the tank circuit resonant frequency. When these two frequencies are matched, the current flow through the induction coil 18 dramatically increases with minor input current change. The size of the heating element 14 will change the inductance of the induction coil 18 which will in turn change the resonance of the tank circuit 86. The elements depicted in FIG. 7 are able to detect the resonant frequency of the tank circuit and match that resonant frequency to the control circuit resonant frequency.

The various elements depicted in FIG. 7 operate in three modes. In a first detection mode, the resonant frequency of the tank circuit 86 is detected. In a second heating mode, the control circuit frequency is adjusted to match the resonant frequency of the tank circuit 86. In a third "off" mode, the control circuit frequency is set to a low value, for example 10 Hz. The elements depicted in FIG. 7 cycle between these three modes.

The tuning circuitry 80 and frequency modulation circuitry 82 together form one embodiment of circuitry which acts match the frequency of AC current to the resonant frequency of the tank circuit. This same matching, or optimisation, can also be achieved in other embodiments by different circuit elements. For example, circuitry for measuring the loaded/unloaded Quality Factor of the tank circuit would allow power transfer to be calculated and optimised during the application of the AC current. While the current may be determined, the energy transferred can be measured to determine how much power is being injected into the inductive load of the tank circuit.

Moreover, tuning of the frequency of AC current to the resonant frequency of the tank circuit could be accomplished continuously by measuring the phase angle of the current relative to the voltage to determine the correct frequency. A phase locked loop would be an example of one approach to achieve this.

Figure 8:
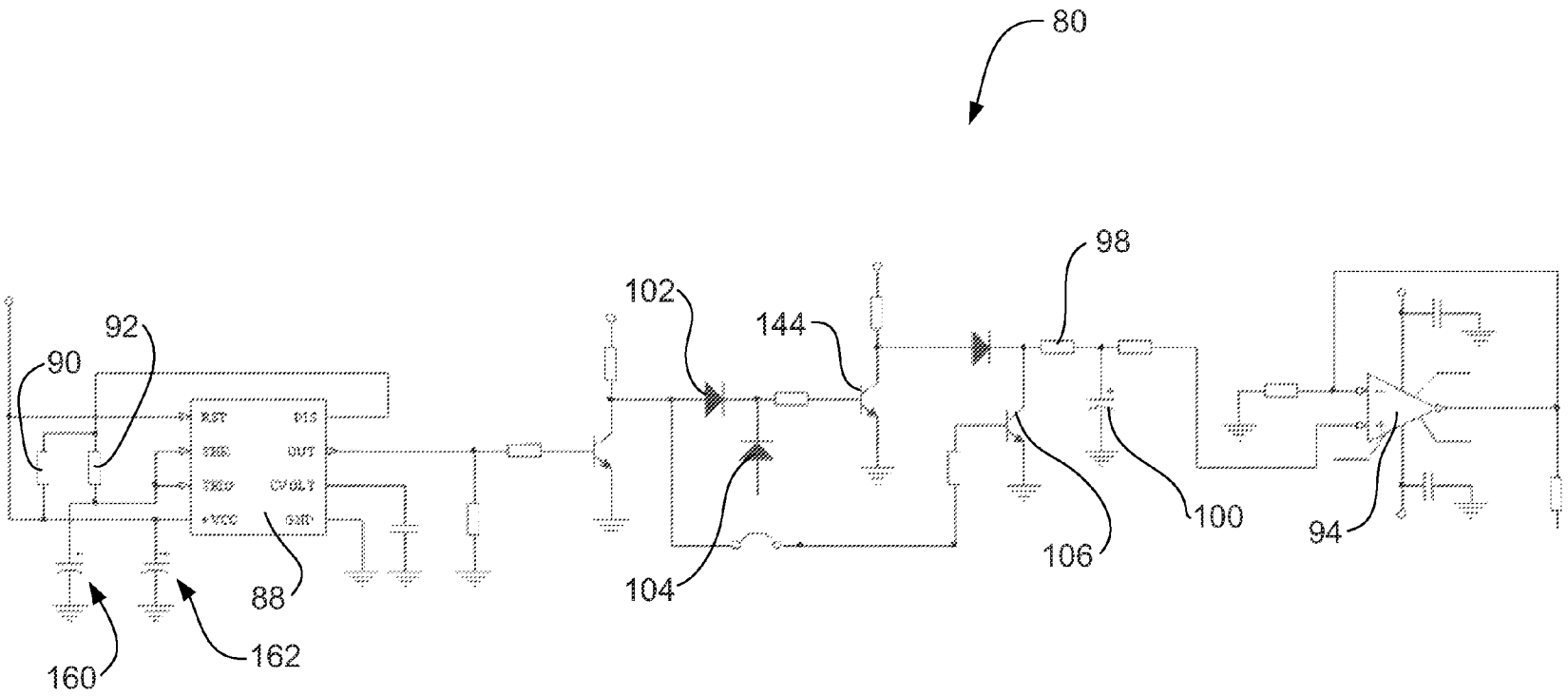
FIGS. 8 to 11 are circuit diagrams each corresponding to a different element depicted in FIG. 6.

Referring now to the tuning circuit 80 shown in FIG. 8, an oscillator 88 through resistors 90 and 92 determined the time spent in "off" mode and the time spent in the "heating" and "detect" modes mentioned above. The transition between the "heating" and "detect" modes is determined by a resonance detector. The buffer amplifier 94 acts as an interface to the frequency modulator circuitry 82 shown in FIG. 9.

Figure 9:
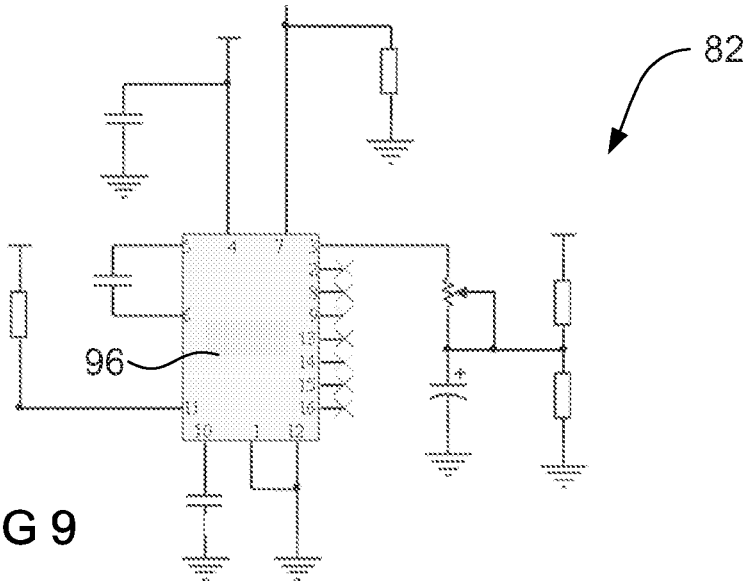

By gradually changing the input voltage to the frequency modulator 96 of the frequency modulator circuitry 82 shown in FIG. 9, from 0 volts to 12 volts, the output frequency of the frequency modulator circuitry 82 gradually changes, for example, from 10 kHz to 100 kHz. The highest frequency is determined by the smallest piece of material that would be used in the heating element 14. The RC circuit created by resistor 98 and capacitor 100 controls the gradient of the input voltage change. The capacitor 100 voltage charge is controlled by signals from the oscillator 88 through diode 102 and a signal from the control circuitry 78 through the diode 104.

Figure 10:
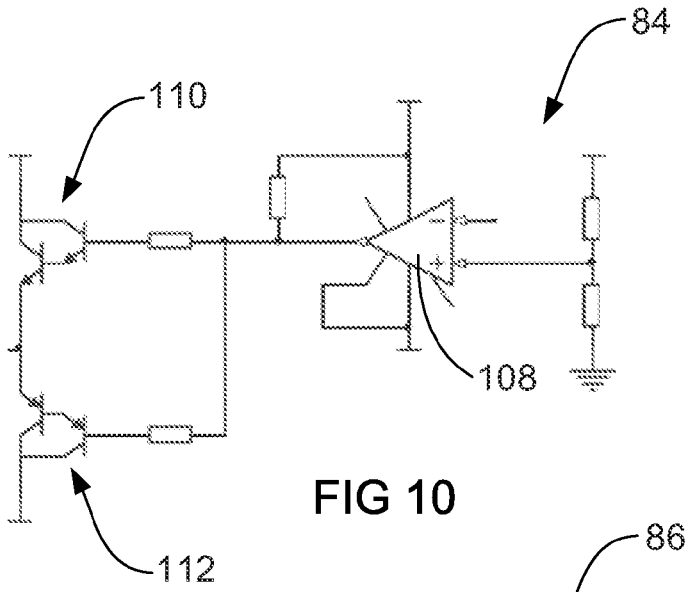

The comparator 108 shown in the switching circuitry 84 depicted in FIG. 10 converts a positive sinusoidal signal from the frequency modulator circuitry 82 to a positive or negative voltage signal (e.g. −12 volts to +12 volts) needed for drive efficiency of the tank circuitry 86. The transistors 110 and 112 act as unity gain buffers for the signal that comes from the comparator 108.

Figure 11:
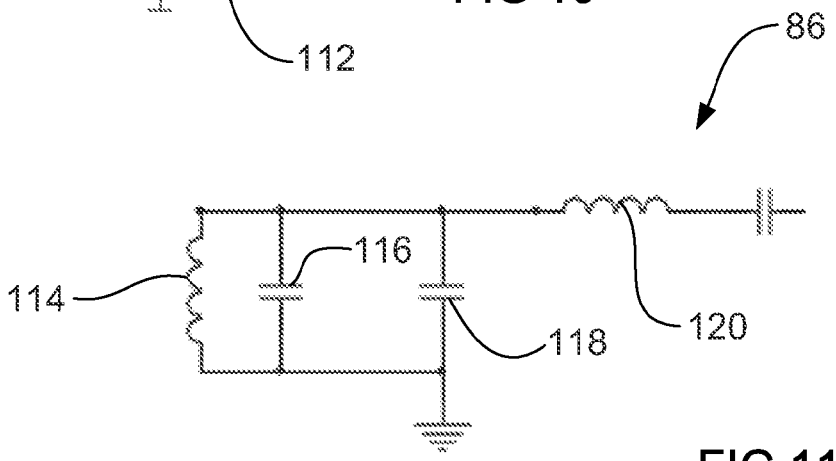

The tank circuit 86 depicted in FIG. 11 shows an inductor 114 corresponding to the inductance of the induction coil 18. The tank circuit 86 also includes tank capacitors 116 and 118 as well as a matching inductor 120.

As previously mentioned, the resonance of the tank circuit dramatically increases the eddy current flow through the heading element 14 without a major change in this circuit input current. The high frequency used in induction heating applications gives rise to a phenomenon called skin effect. This skin effect forces the alternating current to flow in a thin layer at the surface of the conductor being heated. The skin effect increases the effective resistance of the conductor to the eddy currents being generated which are often large. The presence of the metal or other electrically conductive material in the heating element changes the resonant frequency of the tank circuit, such that the skin effect of the heating element is required to be accounted for. It will be understood that this property may vary from container to container.

Figure 12:
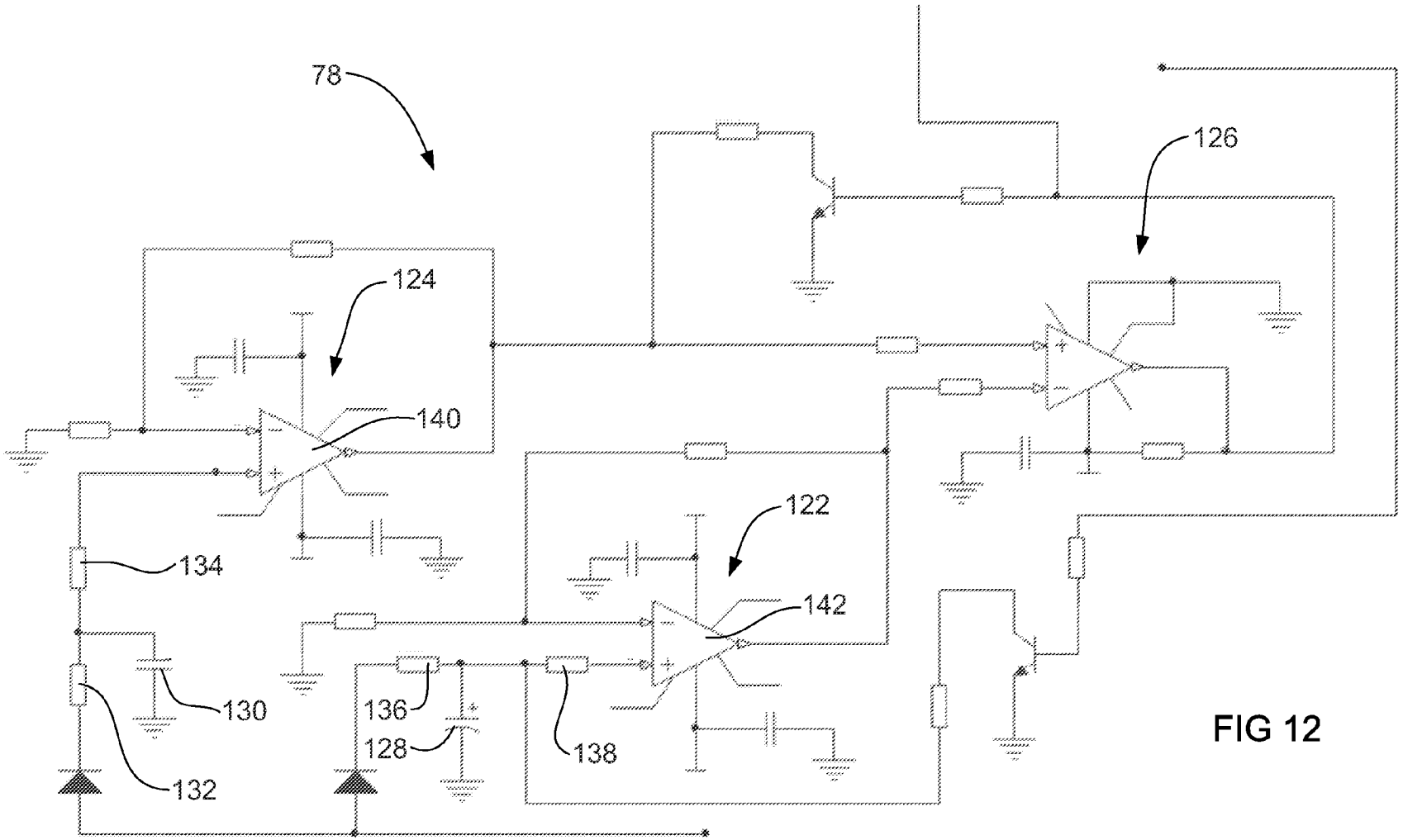
FIGS. 12 and 13 are schematic diagrams depicting two alternative arrangements for location of the heating element and RFID tag with the container forming part of the heating induction system shown in FIG. 1.

The control circuitry 78 shown in FIG. 12 includes two tank capacitor circuits 122 and 124, and a voltage comparator circuit 126. The two capacitor 128 and 130 of the tank circuits 122 and 124 are charged by power from the inductor 114. When resonance of the circuit is achieved, the voltage across the induction coil 114 increases, which in turn charges both capacitors 128 and 130. The capacitor 130 is typically a relatively small capacitor and quickly charges through resistor 132. The capacitor 130 also discharges through resistor 134 due to leakage current. It could be said that the capacitor 130 follows the voltage change across the inductor 114. The capacitor 128 is a larger capacitor compared with the capacitor 130, and charges through resister 136. Due to its greater RC value, the capacitor 128 will be charged slightly slower than the capacitor 130, but the high value of the discharge resistor 138 will dramatically reduce the discharge time. The input bias current of the op-amp determines the discharge current. Both signals are connected through amplifiers 140 and 142 to the voltage comparator 126.

When the resonance detection phase of the induction heating circuitry 20 is selected by the oscillator 88, the voltage across the capacitor 100 will start to rise, which will in turn start to sweep the frequency of the frequency modulator circuitry 96 and switching circuitry 84.

When the tank circuit resonant frequency is achieved, the voltage across the induction coil 18 will be at its maximum, so that control capacitors 128 and 130 will also be charged. The scanning frequency will then start to pass the resonant frequency of the tank circuitry 86, which will in turn cause the voltage across the induction coil 18 to reduce. This voltage reduction will reduce the voltage across the capacitor 130 and cause the voltage across the input of the voltage comparator 126 to change polarity.

This will in turn cause the output of the comparator to change state, through the diode 104 and transistor 144 will stop charging of the capacitor 100 and hence will stop the frequency scanning operation. The capacitor 100 will hold the voltage that it was charged to, and keep the frequency of the circuit at the tank circuit resonant frequency until the next resonant frequency detection phase.

The heater controller 34 causes selective operation of the induction heater circuit 20 by selectively connecting or disconnecting the power supply to the various elements shown in FIG. 7. Moreover, in response to a input desired heating rate, the heater controller 34 is configured to modify the values of capacitors 160 and 162 which are coupled to the oscillator 88 depicted in FIG. 8. These capacitors control the duty cycle of tuning performed by the tuning circuit 80, and the time that the optimal (i.e. frequency matched) current remains on after tuning. Selection of a desired input heating rate will cause the heater controller 34 to modify of the values of capacitors 160 and 162, which by lengthening or shortening the duty cycle and time that the optimal current remains on, thus increasing or decreasing the heating rate.

In one or more embodiments, the desired heating rate can be controlled by selectively turning on or off the power supply to the induction heater control unit 20. In other embodiments, the desired heating rate can be controlled by selectively de-tuning the circuitry by a desired amount, such that the optimal frequency for the circuitry is not achieved, resulting in less than optimal power be transferred to the conductive heating element. In other embodiments the waveform to the driving devices can be modulated so that there is a period in each cycle where neither transistor 110 nor transistor 112 is driven.

Figure 13:
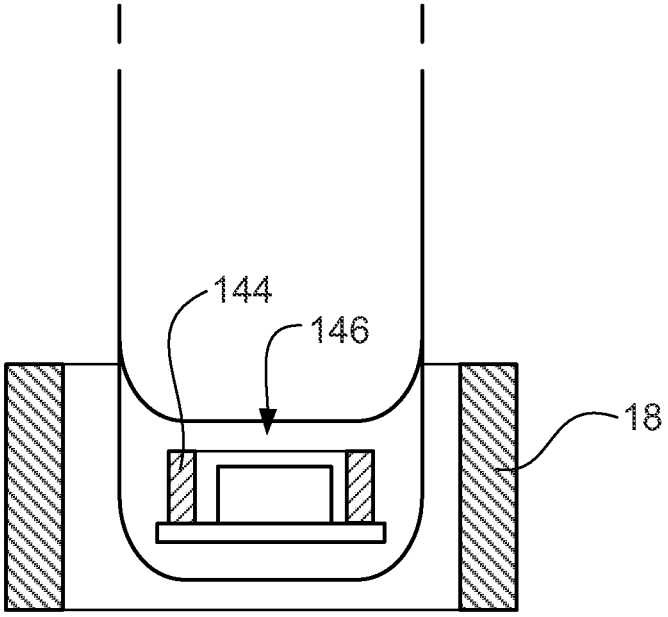

Whilst the embodiment in FIG. 1 depicts the RFID tag 22 located inside the heating element 14, and both the RFID tag and the heating element 14 being formed within a wall of the vial 12, in other embodiments of the invention different co-location arrangements are possible. In a first variation shown in FIG. 13, rather than the heating element 14 and RFID tag 22 being separately formed and then co-located in the wall of the vial 12 during manufacture, the heating element 144 is mounted on the substrate of the RFID tag 146 so that the heating element/RFID tag forms a single heating and temperature detection element.

Figure 14:
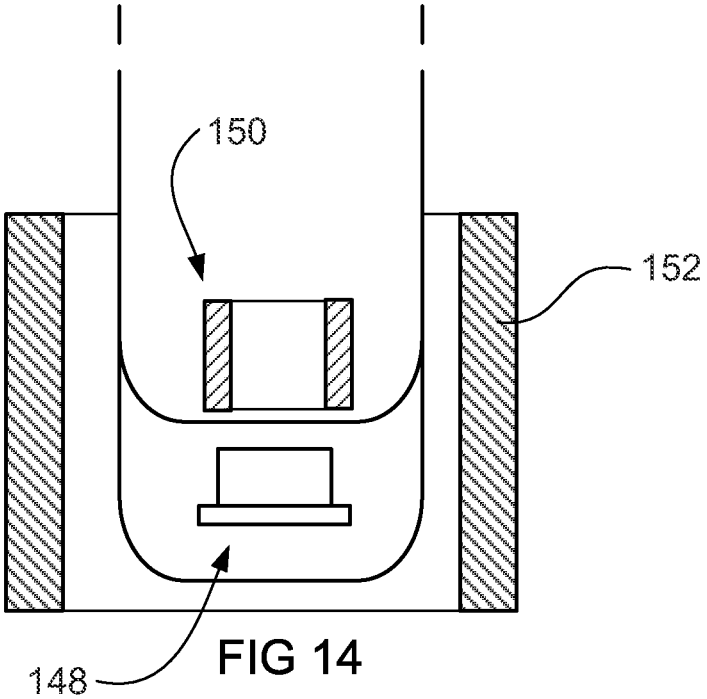

In a second variant shown in FIG. 14, whilst the RFID tag 148 is formed within a wall of the vial, the heating element 150 is separately placed inside the vial prior to heating. In this case, the induction coil 152 must have a sufficient extent to ensure that the generated AC magnetic field is sufficient to heat the heating element 150.

It will be appreciated from the foregoing that the above described induction heating system enables the integration and co-location of a tag and heating element which may be separately manufactured or manufactured as part of the RFID chip fabrication process. The heating element is used to generate heat locally via induction heating, namely a non-contact heating process. This arrangement enables the temperature of the tag and the surrounding material to be heated whilst also enabling interrogation of the tag to determine the temperature experienced by the tag. Accordingly, a closed loop temperature control circuit is provided to enable precise sample temperate control to be obtained.

In a preferred embodiment, the induction heating system further allows for tags and heating elements of varying sizes to be heated under optimal conditions via an auto or self tuning function. The induction heating system determines the oscillating or resonant frequency at which energy can be supplied to the heating element.

Finally, it is to be understood that various modifications and/or additions to the induction heating system described here above may be made without departing from the spirit or ambit of the invention as defined in the claims appended hereto.

The invention claimed is:

1. An induction heating system comprising:

a container to store a substance;

a heating element in thermal contact with the substance;

a machine readable tag in thermal contact with the substance, the tag storing a tag identifier and having a machine readable temperature-dependent characteristic;

an interrogator to read the tag identifier, to read the temperature-dependent characteristic of the tag, and to determine a current temperature of the substance from the temperature-dependent characteristic;

an induction heater to generate an AC magnetic field to heat the heating element; and a heater controller to control operation of the induction heater, in response to the substance temperature determined by the interrogator, to heat the substance.

2. The induction heating system according to claim 1, wherein the tag includes at least one resonant member having the temperature-dependent characteristic.

3. The induction heating system according to claim 2, wherein the temperature-dependent characteristic is a shift in resonant frequency of the resonant member as a function of temperature.

4. The induction heating system according to claim 1, wherein the tag includes a plurality of resonant members encoding the tag identifier.

5. The induction heating system according to claim 4, wherein the resonant members have different resonant frequencies from each other.

6. The induction heating system according to claim 1, wherein the resonant members are vibrated by a Lorentz-type force on application of an excitation signal to the tag.

7. The induction heating system according to claim 1, wherein the tag is affixed to the container.

8. The induction heating system according to claim 7, wherein the tag is formed in a wall of the container.

9. The induction heating system according to claim 1, wherein the heating element is affixed to the container.

10. The induction heating system according to claim 9, wherein the heating element is formed in a wall of the container.

11. The induction heating system according to claim 1, wherein the heating element is mounted on the tag.

12. The induction heating system according to claim 1, wherein the heating element is formed from an electrically conductive material.

13. The induction heating system according to claim 1, wherein the induction heater includes:

an induction coil forming part of a tank circuit;

a control circuit to supply AC current to the tank circuit; and tuning circuitry to match a frequency of the AC current to a resonant frequency of the tank circuit.

14. The induction heating system according to claim 13, wherein the tuning circuitry includes frequency determining circuitry to determine the resonant frequency of the tank circuit and frequency modulation circuitry to adjust the frequency of the AC current to the resonant frequency of the tank circuit.

15. The induction heating system according to claim 1, wherein the heater controller further acts to control operation of the induction heater to heat the substance, in response to an input substance temperature set-point.

16. The induction heating system according to claim 1, wherein the heater controller further acts to control operation of the induction heater to heat the substance, in response to an input substance temperature heating rate.

* * * * *